US010270176B2

(12) United States Patent
Hsu et al.

(10) Patent No.: US 10,270,176 B2
(45) Date of Patent: Apr. 23, 2019

(54) COMMUNICATION DEVICE

(71) Applicant: Wistron NeWeb Corp., Hsinchu (TW)

(72) Inventors: Chieh-Sheng Hsu, Hsinchu (TW); Cheng-Geng Jan, Hsinchu (TW)

(73) Assignee: WISTRON NEWEB CORP., Hsinchu (TW)

( * ) Notice: Subject to any disclaimer, the term of this patent is extended or adjusted under 35 U.S.C. 154(b) by 243 days.

(21) Appl. No.: 15/237,964

(22) Filed: Aug. 16, 2016

(65) Prior Publication Data

US 2017/0331194 A1 Nov. 16, 2017

(30) Foreign Application Priority Data

May 10, 2016 (TW) ..... 105114381 A

(51) Int. Cl.

| | |
|---|---|
| ***H01Q 9/44*** | (2006.01) |
| ***H01Q 1/24*** | (2006.01) |
| ***H01Q 1/36*** | (2006.01) |
| ***H01Q 3/24*** | (2006.01) |
| ***H01Q 11/14*** | (2006.01) |
| ***H01Q 15/14*** | (2006.01) |
| ***H01Q 9/28*** | (2006.01) |
| ***H01Q 19/10*** | (2006.01) |
| ***H01Q 21/20*** | (2006.01) |
| ***H01Q 21/24*** | (2006.01) |

(52) U.S. Cl.

CPC ..... *H01Q 9/44* (2013.01); *H01Q 1/243* (2013.01); *H01Q 1/246* (2013.01); *H01Q 1/36* (2013.01); *H01Q 3/24* (2013.01); *H01Q 9/28* (2013.01); *H01Q 11/14* (2013.01); *H01Q 15/14* (2013.01); *H01Q 19/106* (2013.01); *H01Q 21/205* (2013.01); *H01Q 21/24* (2013.01)

(58) Field of Classification Search

CPC ..... H01Q 15/14; H01Q 3/24; H01Q 21/205; H01Q 21/24; H01Q 21/26; H01Q 25/00

See application file for complete search history.

(56) References Cited

U.S. PATENT DOCUMENTS

| | | | | |
|---|---|---|---|---|
| 5,926,137 A * | 7/1999 | Nealy | H01Q 9/0407 | 343/700 MS |
| 5,940,048 A * | 8/1999 | Martek | H01Q 1/246 | 343/799 |
| 6,127,987 A * | 10/2000 | Maruyama | H01Q 1/36 | 343/824 |
| 6,140,972 A * | 10/2000 | Johnston | H01Q 19/106 | 343/725 |
| 6,972,729 B2 * | 12/2005 | Wang | H01Q 3/44 | 343/833 |

(Continued)

FOREIGN PATENT DOCUMENTS

| | | |
|---|---|---|
| CN | 2781652 Y | 5/2006 |
| TW | 201537832 A | 10/2015 |

*Primary Examiner* — Dameon E Levi
*Assistant Examiner* — Ab Salam Alkassim, Jr.
(74) *Attorney, Agent, or Firm* — McClure, Qualey & Rodack, LLP

(57) ABSTRACT

A communication device includes an antenna system, a metal base, and a metal elevating pillar. The antenna system at least includes a dual-polarized antenna and a reflector. The reflector is configured to reflect radiation energy from the dual-polarized antenna. The metal elevating pillar is coupled between the antenna system and the metal base, and is configured to support the antenna system.

16 Claims, 5 Drawing Sheets

(56) References Cited

U.S. PATENT DOCUMENTS 7,348,930 B2 * 3/2008 Lastinger ..... H01Q 1/246 343/841
7,489,282 B2 * 2/2009 Lastinger ..... H01Q 1/246 343/841
8,279,137 B2 * 10/2012 DeJean, II ..... H01Q 9/0407 343/700 MS
8,390,518 B2 * 3/2013 Haustein ..... H01Q 21/24 343/700 MS
8,482,478 B2 * 7/2013 Hartenstein ..... H01Q 21/24 343/700 MS
8,674,882 B2 * 3/2014 Huang ..... H01Q 1/36 343/700 MS
9,941,580 B2 * 4/2018 Hsu ..... H01Q 1/36
2005/0174298 A1 * 8/2005 Chiang ..... H01Q 1/22 343/834
2006/0109193 A1 * 5/2006 Williams ..... H01Q 1/246 343/797
2006/0114168 A1 * 6/2006 Gottl ..... H01Q 1/246 343/797
2007/0210974 A1 * 9/2007 Chiang ..... H01Q 19/32 343/757
2008/0062062 A1 * 3/2008 Borau ..... H01Q 1/246 343/844
2009/0224995 A1 * 9/2009 Puente ..... H01Q 1/246 343/850
2009/0267856 A1 * 10/2009 Schadler ..... H01Q 1/246 343/797
2010/0085264 A1 * 4/2010 Du ..... H01Q 9/40 343/772
2010/0117914 A1 * 5/2010 Feller ..... H01Q 1/42 343/757
2010/0119002 A1 * 5/2010 Hartenstein ..... H01Q 21/205 375/267
2012/0176945 A1 * 7/2012 Hartenstein ..... H04B 7/0413 370/297
2012/0214425 A1 * 8/2012 Huang ..... H01Q 1/36 455/73
2013/0039355 A1 * 2/2013 de la Garrigue ..... H04W 76/15 370/338
2013/0215832 A1 * 8/2013 Gao ..... H01Q 9/26 370/328
2014/0022131 A1 * 1/2014 Azulay ..... H01Q 1/007 343/727
2014/0118191 A1 * 5/2014 Smith ..... H01Q 19/30 342/372
2015/0122886 A1 * 5/2015 Koch ..... G06K 7/10356 235/440
2015/0215011 A1 * 7/2015 Hartenstein ..... H04B 7/0413 375/267
2015/0263426 A1 * 9/2015 Hsu ..... H01Q 5/378 343/787
2016/0254597 A1 * 9/2016 Weinstein ..... H01Q 1/40 343/872
2017/0085001 A1 * 3/2017 Jan ..... H01Q 9/065
2017/0085009 A1 * 3/2017 Watson ..... H01Q 1/50
2017/0085289 A1 * 3/2017 Jan ..... H04B 7/0617
2017/0222321 A1 * 8/2017 Caratelli ..... H01Q 9/0407
2017/0256863 A1 * 9/2017 Jan ..... H01Q 15/14
2018/0076864 A1 * 3/2018 Jan ..... H01Q 21/28
2018/0183134 A1 * 6/2018 Jan ..... H01Q 15/14
2018/0269589 A1 * 9/2018 Xu ..... H01Q 1/38
2018/0277958 A1 * 9/2018 Yman ..... H01P 5/082
2018/0366816 A1 * 12/2018 Jan ..... H01Q 21/065
2018/0366829 A1 * 12/2018 Hsu ..... H01Q 9/065
2019/0027814 A1 * 1/2019 Hsu ..... H01Q 1/246

* cited by examiner

COMMUNICATION DEVICE

CROSS REFERENCE TO RELATED APPLICATIONS

This Application claims priority of Taiwan Patent Application No. 105114381 filed on May 10, 2016, the entirety of which is incorporated by reference herein.

BACKGROUND OF THE INVENTION

Field of the Invention

The disclosure generally relates to a communication device, and more particularly, to a communication device and an antenna system therein.

Description of the Related Art

With advancements in mobile communication technology, mobile devices such as portable computers, mobile phones, multimedia players, and other hybrid functional portable electronic devices have become more common. To satisfy consumer demand, mobile devices can usually perform wireless communication functions. Some devices cover a large wireless communication area; these include mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, and 2500 MHz. Some devices cover a small wireless communication area; these include mobile phones using Wi-Fi and Bluetooth systems and using frequency bands of 2.4 GHz, 5.2 GHz, and 5.8 GHz.

Wireless access points are indispensable elements for mobile devices in the room to connect to the Internet at a high speed. However, since indoor environments have serious signal reflection and multipath fading, wireless access points should process signals in a variety of polarization directions and from a variety of transmission directions simultaneously. Accordingly, it has become a critical challenge for antenna designers to design a high-gain, multi-polarized antenna in the limited space of wireless access points.

BRIEF SUMMARY OF THE INVENTION

In an exemplary embodiment, the disclosure is directed to a communication device including an antenna system, a metal base, and a metal elevating pillar. The antenna system at least includes a dual-polarized antenna and a reflector. The reflector is configured to reflect radiation energy from the dual-polarized antenna. The metal elevating pillar is coupled between the antenna system and the metal base, and is configured to support the antenna system.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the purposes, features and advantages of the invention, the embodiments and figures of the invention are shown in detail as follows.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". The term "substantially" means the value is within an acceptable error range. One skilled in the art can solve the technical problem within a predetermined error range and achieve the proposed technical performance. Also, the term "couple" is intended to mean either an indirect or direct electrical connection. Accordingly, if one device is coupled to another device, that connection may be through a direct electrical connection, or through an indirect electrical connection via other devices and connections.

Figure 1A:
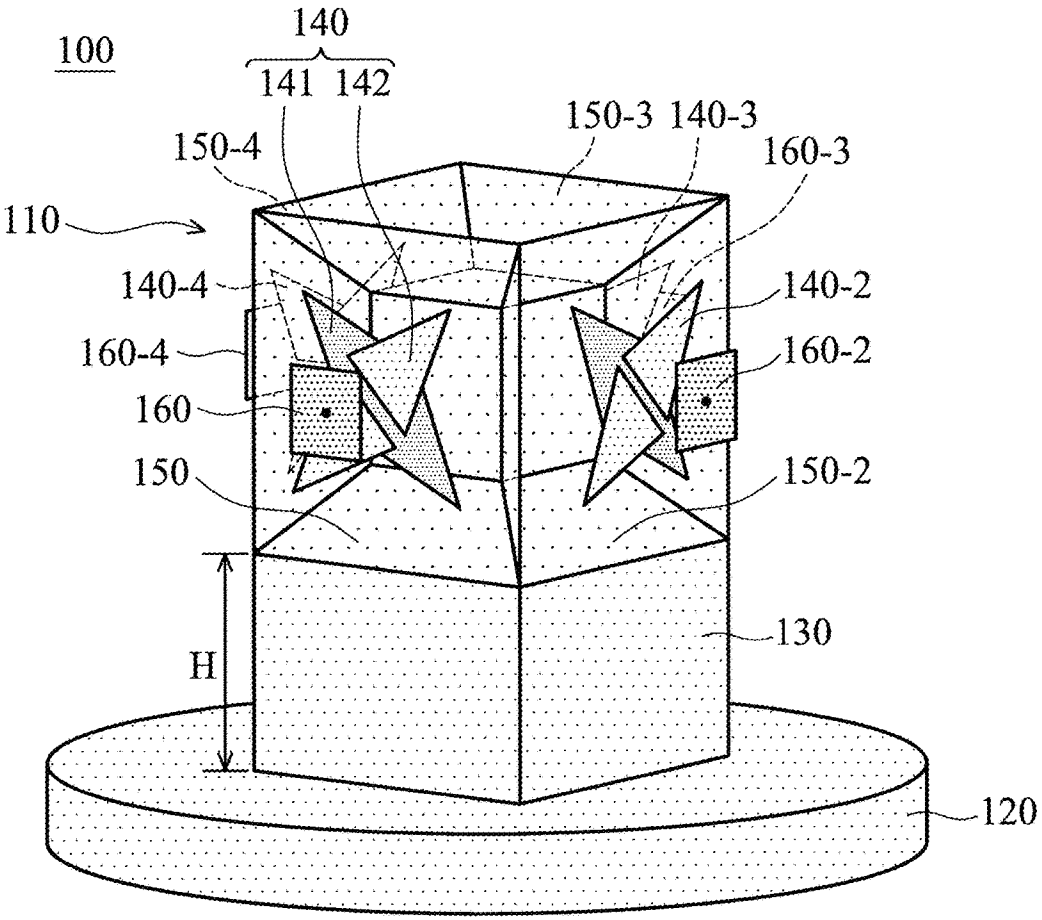
FIG. 1A is a perspective view of a communication device according to an embodiment of the invention.
Figure 1B:
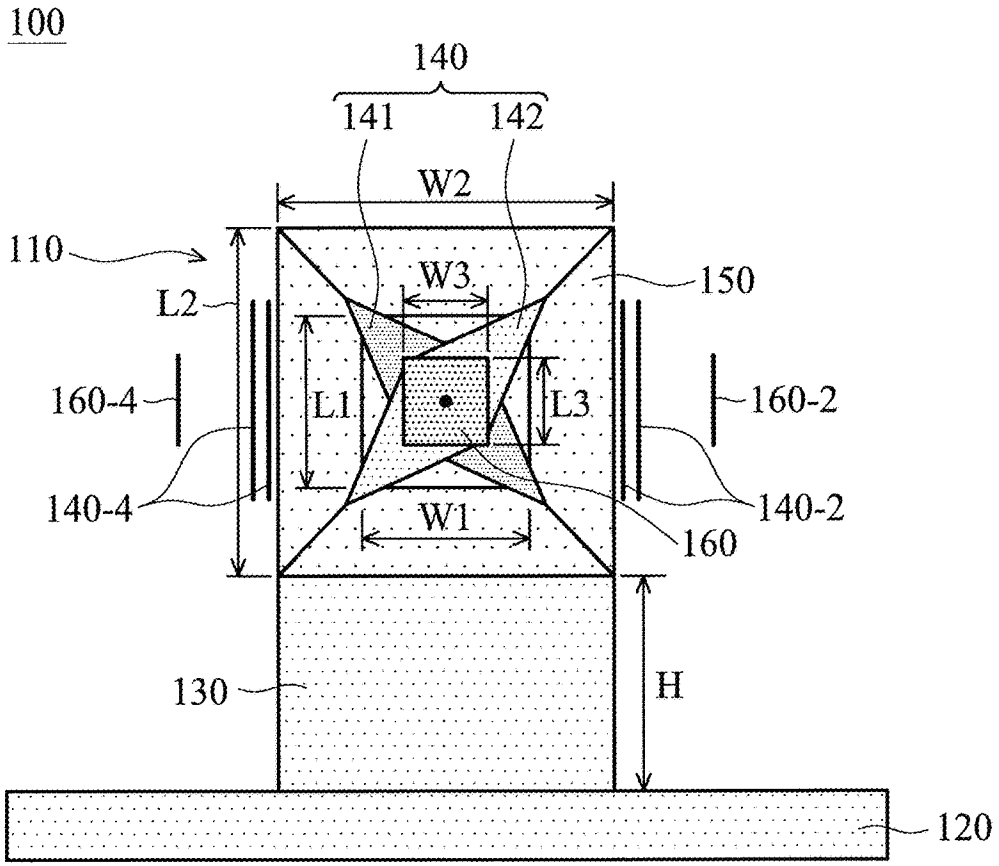
FIG. 1B is a side view of a communication device according to an embodiment of the invention.
Figure 1C:
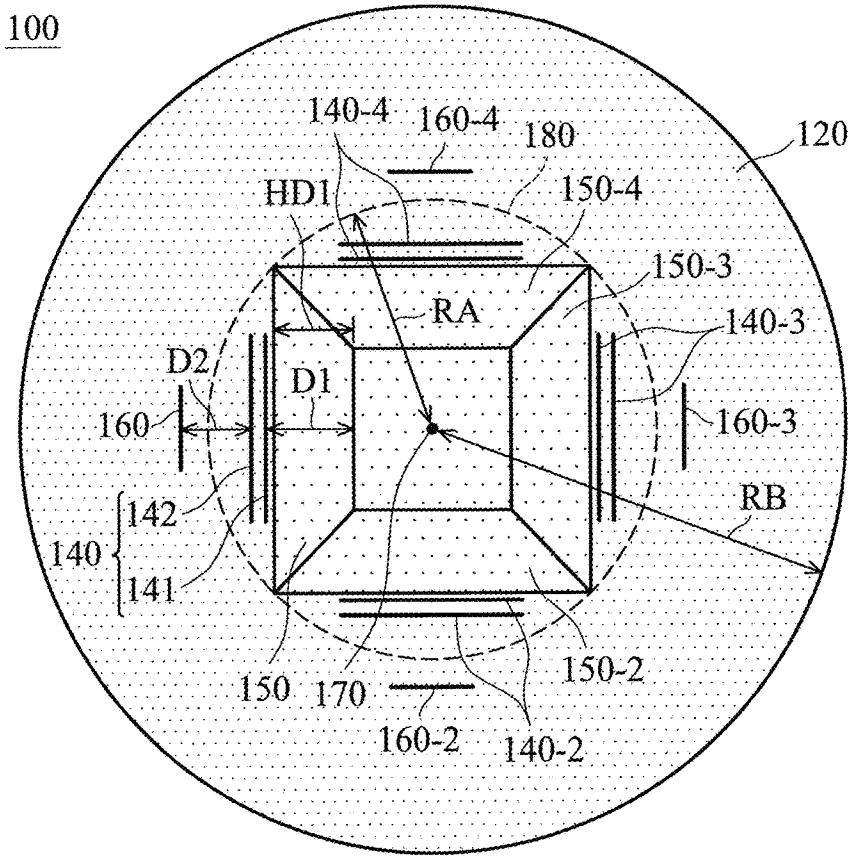
FIG. 1C is a top view of a communication device according to an embodiment of the invention.

FIG. 1A is a perspective view of a communication device 100 according to an embodiment of the invention. FIG. 1B is a side view of the communication device 100 according to an embodiment of the invention. FIG. 1C is a top view of the communication device 100 according to an embodiment of the invention. Please refer to FIG. 1A, FIG. 1B, and FIG. 1C together. The communication device 100 can be applied in a wireless access point. As shown in FIG. 1A, FIG. 1B, and FIG. 1C, the communication device 100 includes an antenna system 110, a metal base 120, and a metal elevating pillar 130. The antenna system 110 at least includes a first dual-polarized antenna 140 and a first reflector 150. The first reflector 150 is configured to reflect the radiation energy from the first dual-polarized antenna 140. The metal base 120 may have a hollow structure for accommodating a variety of electronic circuit elements, such as a processor, an antenna switching module, and a matching circuit. The metal elevating pillar 130 is coupled between the antenna system 110 and the metal base 120, and is configured to support the antenna system 110. It should be understood that the communication device 100 may include other components, such as a dielectric substrate, a power supply module, and an RF (Radio Frequency) module although they are not displayed in FIG. 1A, FIG. 1B, and FIG. 1C. In some embodiments, the communication device 100 further include a cylindrical nonconductive antenna cover, and the antenna system 110 and the metal elevating pillar 130 may be disposed in the cylindrical nonconductive antenna cover.

The first dual-polarized antenna 140 includes a first dipole antenna element 141 and a second dipole antenna element 142. The first dipole antenna element 141 and the second dipole antenna element 142 may be perpendicular to each other, so as to achieve the dual-polarized characteristics. For example, if the first dipole antenna element 141 has a first polarization direction and the second dipole antenna element 142 has a second polarization direction, the first polarization direction may be perpendicular to the second polarization direction. In order to increase the operation bandwidth, the first dipole antenna element 141 and the second dipole antenna element 142 may be diamond-shaped dipole antenna elements. However, the invention is not limited to the above. In other embodiments, the first dual-polarized antenna 140 includes two different-type antenna elements, such as two monopole antenna elements or two patch antenna elements.

The first reflector 150 has a pyramidal shape (hollow structure) with a wide top opening and a narrow bottom plate. The wide top opening of the first reflector 150 faces the first dual-polarized antenna 140. Specifically, the wide top opening of the first reflector 150 has a relatively large square shape, and the narrow bottom plate of the first reflector 150 has a relatively small square shape. The first reflector 150 is configured to eliminate the back-side radiation of the first dual-polarized antenna 140 and to enhance the front-side radiation of the first dual-polarized antenna 140. Accordingly, the antenna gain of the first dual-antenna polarized antenna 140 is increased. The invention is not limited to the above. In alternative embodiments, the first reflector 150 has a lidless cubic shape or a lidless cylindrical shape (hollow structure), and its top opening still faces the first dual-polarized antenna 140, without affecting the performance of the invention.

In some embodiments, the antenna system 110 further includes a first metal plate 160. The first dual-polarized antenna 140 is positioned between the first metal plate 160 and the first reflector 150. The first metal plate 160, the first dual-polarized antenna 140, and the bottom plate of the first reflector 150 may be parallel to each other. The first metal plate 160 may have different shapes, such as a square shape, a circular shape, or an equilateral triangular shape. Specifically, the area of the first metal plate 160 may be smaller than the area of the first dual-polarized antenna 140, and the vertical projection of the first metal plate 160 may be completely inside the bottom plate of the first reflector 150. Since the first dipole antenna element 141 and the second dipole antenna element 142 of the first dual-polarized antenna 140 have slightly different distances to the first reflector 150, the first metal plate 160 is used as an optional element for balancing and equalizing the radiation gain of the first dipole antenna element 141 and the second dipole antenna element 142. In alternative embodiments, the first metal plate 160 is removed from the antenna system 110.

Figure 2:
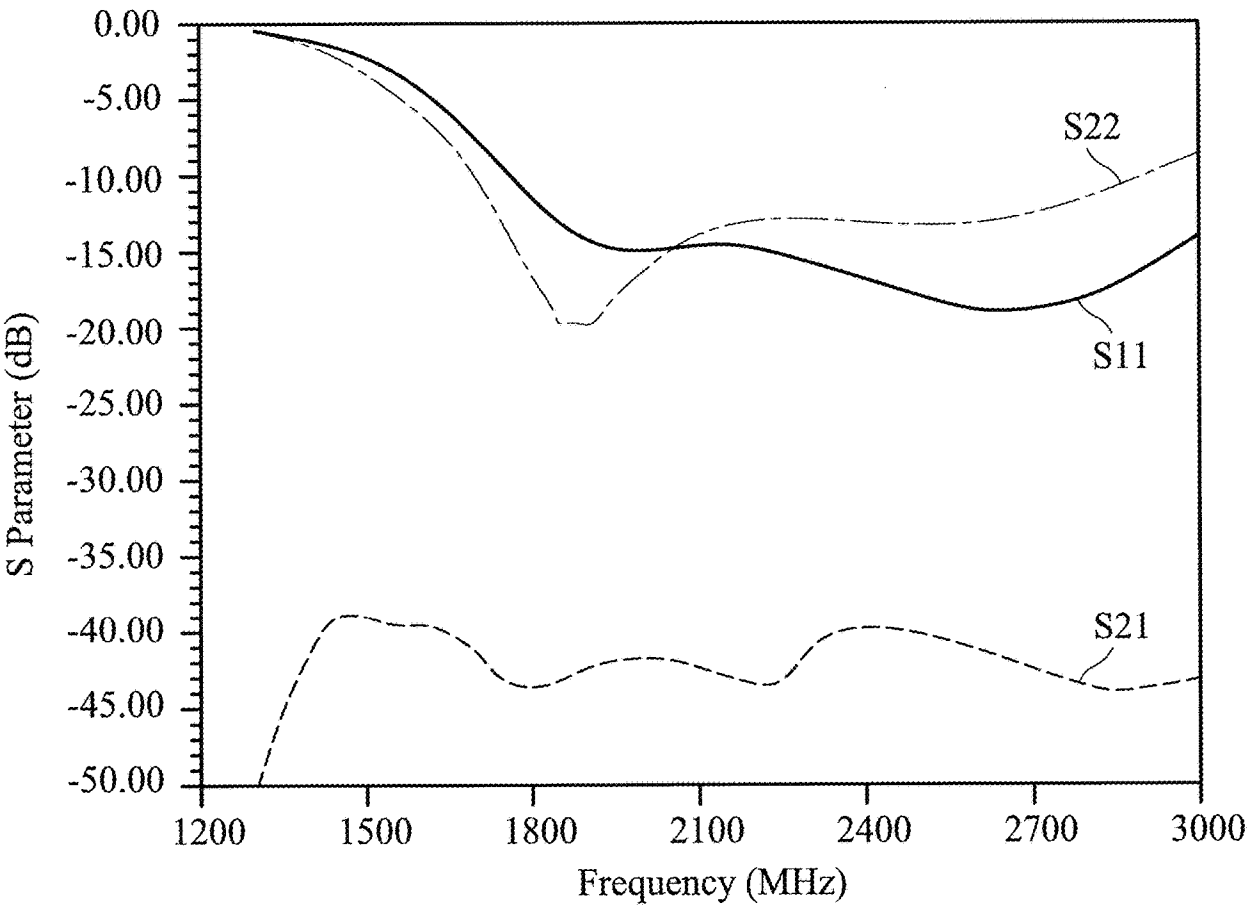
FIG. 2 is an S-parameter diagram of a dual-polarized antenna of an antenna system of a communication device according to an embodiment of the invention.

FIG. 2 is an S-parameter diagram of the first dual-polarized antenna 140 of the antenna system 110 of the communication device 100 according to an embodiment of the invention. The horizontal axis represents the operation frequency (MHz), and the vertical axis represents the S-parameters (dB). In the embodiment of FIG. 2, the first dipole antenna element 141 of the first dual-polarized antenna 140 is set as a first port (Port 1), and the second dipole antenna element 142 of the first dual-polarized antenna 140 is set as a second port (Port 2). A first curve S11 represents the S11 parameter of the first dipole antenna element 141. A second curve S22 represents the S22 parameter of the second dipole antenna element 142. A third curve S21 represents the S21 (or S12) parameter between the first dipole antenna element 141 and the second dipole antenna element 142. According to the measurement result of FIG. 2, both the first dipole antenna element 141 and the second dipole antenna element 142 of the first dual-polarized antenna 140 cover an operation frequency band from 1850 MHz to 2690 MHz. Within the aforementioned operation frequency band, the S21 parameter between the first dipole antenna element 141 and the second dipole antenna element 142 is below −40 dB. Therefore, the first dual-polarized antenna 140 can cover the LTE (Long Term Evolution) wideband operation, and its isolation between antennas can be very good.

In some embodiments, the element sizes of the antenna system 110 are as follows. In order to generate constructive interference, the distance D1 between the first reflector 150 and the first dual-polarized antenna 140 (or the first dipole antenna element 141) is slightly longer than 0.25 wavelength (λ/4) of the operation frequency band of the first dual-polarized antenna 140. The aforementioned distance D1 is from 24 mm to 30 mm, such as 27 mm. The distance D2 between the first metal plate 160 and the first dual-polarized antenna 140 (or the second dipole antenna element 142) is from 19 mm to 25 mm, such as 22 mm. The length L1 of the narrow bottom plate of the first reflector 150 is from 45 mm to 55 mm, such as 50 mm. The width W1 of the narrow bottom plate of the first reflector 150 is from 45 mm to 55 mm, such as 50 mm. The length L2 of the wide top opening of the first reflector 150 is from 90 mm to 110 mm, such as 99.5 mm. The width W2 of the wide top opening of the first reflector 150 is from 90 mm to 110 mm, such as 99.5 mm. The depth HD1 of the first reflector 150 (i.e., the distance between its top opening and bottom plate) is from 22 mm to 27 mm, such as 24.7 mm. The length L3 of the first metal plate 160 is from 22 mm to 27 mm, such as 25 mm. The width W3 of the first metal plate 160 is from 22 mm to 27 mm, such as 25 mm. In some embodiments, the length L3 or the width W3 of the first metal plate 160 is shorter than 0.5 wavelength (λ/2) of the operation frequency band of the first dual-polarized antenna 140. The above element sizes are calculated according to many simulation results, and they are arranged for optimizing the antenna gain and isolation of the antenna system 110.

In some embodiments, the antenna system 110 further includes a second dual-polarized antenna 140-2 and a second reflector 150-2. The second reflector 150-2 is configured to reflect the radiation energy from the second dual-polarized antenna 140-2. The antenna system 110 may further include a second metal plate 160-2. The second dual-polarized antenna 140-2 may be positioned between the second metal plate 160-2 and the second reflector 150-2. The second dual-polarized antenna 140-2 is disposed opposite to or adjacent to the first dual-polarized antenna 140. The structures and functions of the second dual-polarized antenna 140-2, the second reflector 150-2, and the second metal plate 160-2 are the same as those of the first dual-polarized antenna 140, the first reflector 150, and the first metal plate 160, and the only difference is that they are arranged toward different directions.

In some embodiments, the antenna system 110 further includes a third dual-polarized antenna 140-3 and a third reflector 150-3. The third reflector 150-3 is configured to reflect the radiation energy from the third dual-polarized antenna 140-3. The antenna system 110 may further include a third metal plate 160-3. The third dual-polarized antenna 140-3 may be positioned between the third metal plate 160-3 and the third reflector 150-3. The third dual-polarized antenna 140-3 is disposed opposite to or adjacent to the first dual-polarized antenna 140. The structures and functions of the third dual-polarized antenna 140-3, the third reflector 150-3, and the third metal plate 160-3 are the same as those of the first dual-polarized antenna 140, the first reflector 150, and the first metal plate 160, and the only difference is that they are arranged toward different directions.

In some embodiments, the antenna system 110 further includes a fourth dual-polarized antenna 140-4 and a fourth reflector 150-4. The fourth reflector 150-4 is configured to reflect the radiation energy from the fourth dual-polarized antenna 140-4. The antenna system 110 may further include a fourth metal plate 160-4. The fourth dual-polarized antenna 140-4 may be positioned between the fourth metal plate 160-4 and the fourth reflector 150-4. The fourth dual-polarized antenna 140-4 is disposed opposite to or adjacent to the first dual-polarized antenna 140. The structures and functions of the fourth dual-polarized antenna 140-4, the fourth reflector 150-4, and the fourth metal plate 160-4 are the same as those of the first dual-polarized antenna 140, the first reflector 150, and the first metal plate 160, and the only difference is that they are arranged toward different directions.

Please refer to FIG. 1A, FIG. 1B, and FIG. 1C again. The first dual-polarized antenna 140, the second dual-polarized antenna 140-2, the third dual-polarized antenna 140-3, and the fourth dual-polarized antenna 140-4 are arranged symmetrically with respect to their central point 170. Each of the first dual-polarized antenna 140, the second dual-polarized antenna 140-2, the third dual-polarized antenna 140-3, and the fourth dual-polarized antenna 140-4 covers a 90-degree spatial angle. Similarly, the first reflector 150, the second reflector 150-2, the third reflector 150-3, the fourth reflector 150-4, the first metal plate 160, the second metal plate 160-2, the third metal plate 160-3, and the fourth metal plate 160-4 are also arranged symmetrically with respect to their central point 170. The first dual-polarized antenna 140, the second dual-polarized antenna 140-2, the third dual-polarized antenna 140-3, and the fourth dual-polarized antenna 140-4 have the same operation frequency band. In some embodiments, the antenna system 110 is a beam switching antenna assembly for selectively using one of the first dual-polarized antenna 140, the second dual-polarized antenna 140-2, the third dual-polarized antenna 140-3, and the fourth dual-polarized antenna 140-4 to perform signal reception and transmission. For example, when reception signals come from a variety of directions, the antenna system 110 can enable only one dual-polarized antenna toward the direction of maximum signal strength, and disable other dual-polarized antennas. It should be understood that although there are exactly four dual-polarized antennas displayed in FIG. 1A, FIG. 1B, and FIG. 1C, in fact, the antenna system 110 may include more or less antennas. For example, the antenna system 110 may include only one or more of the first dual-polarized antenna 140, the second dual-polarized antenna 140-2, the third dual-polarized antenna 140-3, and the fourth dual-polarized antenna 140-4. Generally, if the antenna system 110 includes N dual-polarized antennas (e.g., N may be an integer greater than or equal to 2), the N dual-polarized antennas are arranged on the same circumference at equal intervals, and each minor arc between any two adjacent dual-polarized antennas has 360/N degrees.

According to practical measurement, when the area of the metal base 120 is different from the bottom area of the antenna system 110, it has a negative impact on the radiation pattern and the cross-polarization isolation of the antenna system 110. Generally, the area of the metal base 120 is designed according to the lowest operation frequency, and it is often larger than the bottom area of the antenna system 110. To overcome this drawback, in an embodiment, the invention adds the metal elevating pillar 130 for modifying the radiation pattern of the antenna system 110 and increasing the cross-polarization isolation of the antenna system 110. The height H of the metal elevating pillar 130 on the metal base 120 is determined according to the bottom area of the antenna system 110 and the area of the metal base 120.

Please refer to FIG. 1C again. The bottom surface of the antenna system 110 has a circumscribed circle 180 with a first radius RA, and the metal base 120 has a circular shape with a second radius RB. The height H of the metal elevating pillar 130 is linearly related to the ratio of the second radius RB to the first radius RA. Specifically, the height H of the metal elevating pillar 130 may be calculated according to the following equation (1).

$$H = 0.75 \times \lambda_0 \times \left(\frac{RB}{RA} - 1\right) \tag{1}$$

where H represents the height of the metal elevating pillar 130, $\lambda_0$ represents a free-space wavelength of the operation frequency band of the antenna system 110, RA represents the first radius, and RB represents the second radius.

The formula for calculating the height H of the metal elevating pillar 130 is derived based on a regression line and analysis of many experimental results, and it can effectively prevent the metal base 120 from interfering with the antenna system 110. In a special case, if the second radius RB is equal to the first radius RA (i.e., the area of the metal base 120 is exactly equal to the bottom area of the antenna system 110), the height H of the metal elevating pillar 130 will be exactly zero. In other words, the metal elevating pillar 130 is configured to compensate for the mismatch between the area of the metal base 120 and the bottom area of the antenna system 110; if they have the same area, there will be no need to design the metal elevating pillar 130. In some embodiments, the top area of the metal elevating pillar 130 is the same as the bottom area of the antenna system 110. In some embodiments, the metal elevating pillar 130 is designed as a pillar corresponding to the shape of the bottom surface of the antenna system 110. For example, if the antenna system 110 has a circular bottom surface, the metal elevating pillar 130 may be a cylinder. Alternatively, for example, if the antenna system 110 has a square bottom surface, the metal elevating pillar 130 may be a square cylinder.

Figure 3:
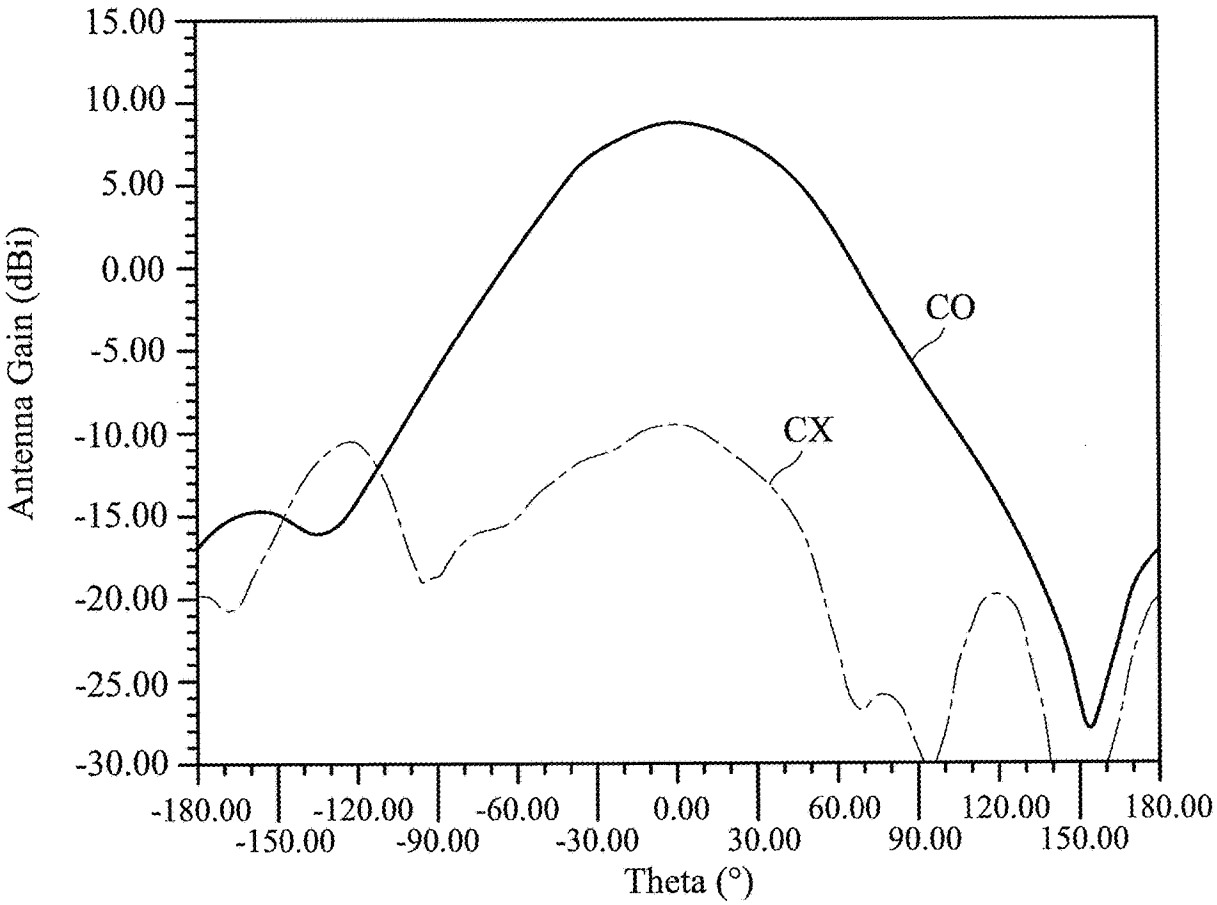
FIG. 3 is a radiation pattern of a dipole antenna element of a dual-polarized antenna of an antenna system of a communication device according to an embodiment of the invention.

FIG. 3 is a radiation pattern of the second dipole antenna element 142 of the first dual-polarized antenna 140 of the antenna system 110 of the communication device 100 according to an embodiment of the invention. The horizontal axis represents the zenith angle (theta) (degree), and the vertical axis represents the antenna gain (dBi). In the embodiments of FIG. 3, a fourth curve CO represents the co-polarization radiation pattern, and a fifth curve CX represents the cross-polarization radiation pattern. According to the measurement result of FIG. 3, within the aforementioned operation frequency band from 1850 MHz to 2690 MHz, the maximum antenna gain of the first dual-polarized antenna 140 is about 8.6 dBi, and the cross-polarization isolation of the first dual-polarized antenna 140 is about 18.1 dB. That is, the incorporation of the metal elevating pillar 130 can make the radiation pattern and the cross-polarization isolation of the antenna system 110 meet the requirements of practical application.

The invention proposes a communication device whose antenna system has the advantages of high isolation, high cross-polarization isolation, and high antenna gain. The invention is suitable for application in a variety of indoor environments, so as to solve the problem of poor communication quality due to signal reflection and multipath fading in conventional designs.

Note that the above element sizes, element parameters, element shapes, and frequency ranges are not limitations of the invention. An antenna designer can fine-tune these settings or values according to different requirements. It should be understood that the communication device and antenna system of the invention are not limited to the configurations of FIGS. 1-3. The invention may merely include any one or more features of any one or more embodiments of FIGS. 1-3. In other words, not all of the features displayed in the figures should be implemented in the communication device and antenna system of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

While the invention has been described by way of example and in terms of the preferred embodiments, it is to be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A communication device, comprising:

an antenna system, comprising a first dual-polarized antenna and a first reflector, wherein the first reflector is configured to reflect radiation energy from the first dual-polarized antenna;

a metal base; and a metal elevating pillar, coupled between the antenna system and the metal base, and configured to support the antenna system;

wherein a distance between the first reflector and the first dual-polarized antenna is slightly longer than 0.25 wavelength of an operation frequency band, wherein a bottom surface of the antenna system has a circumscribed circle with a first radius, the metal base has a circular shape with a second radius, and a height of the metal elevating pillar is linearly related to a ratio of the second radius to the first radius;

wherein the height of the metal elevating pillar is calculated according to the following equation:

$$H = 0.75 \times \lambda_0 \times \left(\frac{RB}{RA} - 1\right)$$

wherein H represents the height of the metal elevating pillar, $\lambda_0$ represents a free-space wavelength of an operation frequency band of the antenna system, RA represents the first radius, and RB represents the second radius.

2. The communication device as claimed in claim 1, wherein the first reflector has a pyramidal shape with a wide top opening and a narrow bottom plate, and the wide top opening of the first reflector faces the first dual-polarized antenna.

3. The communication device as claimed in claim 2, wherein the wide top opening of the first reflector has a relatively large square shape, and the narrow bottom plate of the first reflector has a relatively small square shape.

4. The communication device as claimed in claim 1, wherein the first dual-polarized antenna comprises a first dipole antenna element and a second dipole antenna element, and the first dipole antenna element and the second dipole antenna element are perpendicular to each other.

5. The communication device as claimed in claim 4, wherein the first dipole antenna element and the second dipole antenna element are diamond-shaped dipole antenna elements.

6. The communication device as claimed in claim 1, wherein the first dual-polarized antenna covers the operation frequency band from 1850 MHz to 2690 MHz.

7. The communication device as claimed in claim 4, wherein the antenna system further comprises a first metal plate for balancing radiation gain of the first dipole antenna element and the second dipole antenna element, and the first dual-polarized antenna is positioned between the first metal plate and the first reflector.

8. The communication device as claimed in claim 7, wherein the first metal plate has a square shape, a circular shape, or an equilateral triangular shape.

9. The communication device as claimed in claim 7, wherein a length or a width of the first metal plate is shorter than 0.5 wavelength of an operation frequency band of the first dual-polarized antenna.

10. The communication device as claimed in claim 1, wherein the antenna system further comprises a second dual-polarized antenna and a second reflector, the second reflector is configured to reflect radiation energy from the second dual-polarized antenna, and the second dual-polarized antenna is disposed opposite to or adjacent to the first dual-polarized antenna.

11. The communication device as claimed in claim 10, wherein the antenna system further comprises a second metal plate, and the second dual-polarized antenna is positioned between the second metal plate and the second reflector.

12. The communication device as claimed in claim 10, wherein the antenna system further comprises a third dual-polarized antenna, a fourth dual-polarized antenna, a third reflector, and a fourth reflector, the third reflector is configured to reflect radiation energy from the third dual-polarized antenna, and the fourth reflector is configured to reflect radiation energy from the fourth dual-polarized antenna.

13. The communication device as claimed in claim 12, wherein the antenna system further comprises a third metal plate and a fourth metal plate, the third dual-polarized antenna is positioned between the third metal plate and the third reflector, and the fourth dual-polarized antenna is positioned between the fourth metal plate and the fourth reflector.

14. The communication device as claimed in claim 12, wherein the first dual-polarized antenna, the second dual-polarized antenna, the third dual-polarized antenna, and the fourth dual-polarized antenna are arranged symmetrically with respect to their central point, and each of them covers a 90-degree spatial angle.

15. The communication device as claimed in claim 12, wherein the antenna system is a beam switching antenna assembly for selectively using one of the first dual-polarized antenna, the second dual-polarized antenna, the third dual-polarized antenna, and the fourth dual-polarized antenna to perform signal reception and transmission.

16. The communication device as claimed in claim 1, wherein a top area of the metal elevating pillar is the same as a bottom area of the antenna system.

* * * * *